United States Patent [19]

Berry et al.

[11] Patent Number: 4,715,761

[45] Date of Patent: Dec. 29, 1987

[54] UNIVERSAL FLOOR MOUNTED PIPE HANDLING MACHINE

[75] Inventors: Joe R. Berry, Round Rock; Faustyn C. Langowski, Georgetown; James G. Renfro, Austin; Roger Smith, Jr., Georgetown, all of Tex.

[73] Assignee: Hughes Tool Company, Houston, Tex.

[21] Appl. No.: 21,618

[22] Filed: Mar. 3, 1987

Related U.S. Application Data

[63] Continuation of Ser. No. 760,388, Jul. 30, 1985, abandoned.

[51] Int. Cl.[4] ..... E21B 19/14

[52] U.S. Cl. ..... 414/22; 104/35; 105/31; 175/85; 414/590; 414/742; 901/1; 901/17

[58] Field of Search ..... 414/22, 589, 590, 618, 414/619, 620, 688, 728, 742, 745; 175/52, 85; 104/35, 48, 162; 105/31, 32; 254/35, 37; 901/1, 6, 17

[56] References Cited

U.S. PATENT DOCUMENTS

| | | | |
|---|---|---|---|
| 1,987,982 | 1/1935 | Wheeler | 414/688 X |
| 2,391,657 | 12/1945 | Tavelin | 105/31 |
| 2,615,681 | 10/1952 | True | 414/22 X |
| 2,677,475 | 5/1954 | Davies et al. | 414/620 |
| 2,933,210 | 4/1960 | Dye | 414/547 |
| 3,177,944 | 4/1965 | Knights | 166/77.5 |
| 3,288,000 | 11/1966 | Foster | 175/85 X |
| 3,543,910 | 12/1970 | Devol | 414/728 |
| 3,561,811 | 2/1971 | Turner, Jr. | 294/90 |
| 3,628,674 | 12/1971 | Koike et al. . | |
| 3,747,192 | 7/1973 | Harris et al. | 414/745 |
| 3,834,555 | 9/1974 | Bennington et al. | 414/627 |
| 3,840,128 | 10/1974 | Swoboda et al. | 414/728 |
| 3,921,823 | 11/1975 | Bourree et al. | 175/85 X |
| 4,069,879 | 1/1978 | Brown et al. | 175/85 X |
| 4,230,190 | 10/1980 | Guinn et al. | 175/85 X |
| 4,273,506 | 6/1981 | Thomson et al. | 414/735 |
| 4,289,441 | 9/1981 | Inaba et al. | 414/589 |
| 4,348,920 | 9/1982 | Boyadjieff | 81/57.25 |
| 4,430,037 | 2/1984 | Bisiach | 414/4 |
| 4,502,830 | 3/1985 | Inaba et al. | 901/17 X |

FOREIGN PATENT DOCUMENTS

| | | | |
|---|---|---|---|
| 494268 | 2/1977 | Australia | 104/35 |

OTHER PUBLICATIONS

Japanese PCT Publication WO82/01154 to Fujitsu; published Apr. 1982.

*Primary Examiner*—Leslie J. Paperner
*Attorney, Agent, or Firm*—Charles D. Gunter, Jr.; H. Dennis Kelly

[57] ABSTRACT

A pipe handling machine having vertical tracks mounted on a rotatable base. A carriage is mounted on the vertical tracks for vertical movement. A multisection telescoping boom is mounted on the carriage, and a pipe-engaging head is mounted on the end of the boom. The base may be carried on a movable trolley, which engages a set of tracks. The tracks run across the rig floor, from well center to a setback area. A second set of tracks may run across the rig floor, transverse to the first set.

3 Claims, 9 Drawing Figures

UNIVERSAL FLOOR MOUNTED PIPE HANDLING MACHINE

This application is a continuation, of application Ser. No. 760,388, filed July 30, 1985, now abandoned.

BACKGROUND OF THE INVENTION

1. Field of the Invention

The invention relates in general to oil well drilling equipment, and in particular to pipe handling machines for handling sections of drill pipe, drill collars, and the like.

2. Description of the Prior Art

During the drilling of oil wells, it is necessary to periodically move sections of drill pipe from a setback area to the well center, so that the sections of pipe can be added to the drill string. Also, whenever the drill string is removed from the well, the sections of pipe must be returned from the well center to the setback area for temporary storage.

Generally, sections of drill pipe are moved between well center and the setback area in an essentially vertical position. The sections are lifted by a pipe elevator attached to the upper end of the section. The elevator is suspended from a travelling block in a derrick. When the upper end of the pipe section is being lifted, the lower end of the pipe tends to sway, creating a hazard to personnel and to equipment. Therefore, the lower end of the section must be controlled in some manner.

Manual control of the lower end of the section is dangerous and unreliable. The large mass and unpredictable movements of the pipe section make it difficult for rig hands to control a section. This problem is particularly acute on offshore rigs, which are subject to severe pitching and rolling due to high winds and waves.

A number of racking arms and similar machines have been developed to mechanically handle vertically suspended pipe sections. For example, U.S. Pat. No. 3,840,128 shows a racking arm for handling drill pipe. This device is supported on a pedestal, permanently mounted on the rig floor. The racking arm thus cannot be easily moved out of the way. On a crowded rig floor that may be a serious problem.

SUMMARY OF THE INVENTION

The pipe handling machine of the invention has a base, which is rotatable about a vertical axis. A vertically movable carriage is mounted on a pair of vertical tracks, which extend upward from the base. The carriage supports a boom, which can be extended and retracted and can be luffed about a horizontal axis. A pipe-engaging head is located at the end of the boom, for controlling the pipe section.

The base of the machine may be mounted on a trolley, which engages a set of tracks extending across the rig floor. The trolley can be moved along the tracks across the rig floor. The tracks will preferably extend between the well center and the setback area. A second set of tracks may extend across the rig floor transverse to the first set, and in front of or behind the setback area.

The above as well as additional objects, features, and advantages of the invention will become apparent in the following detailed description.

DESCRIPTION OF THE PREFERRED EMBODIMENT

Figure 1:
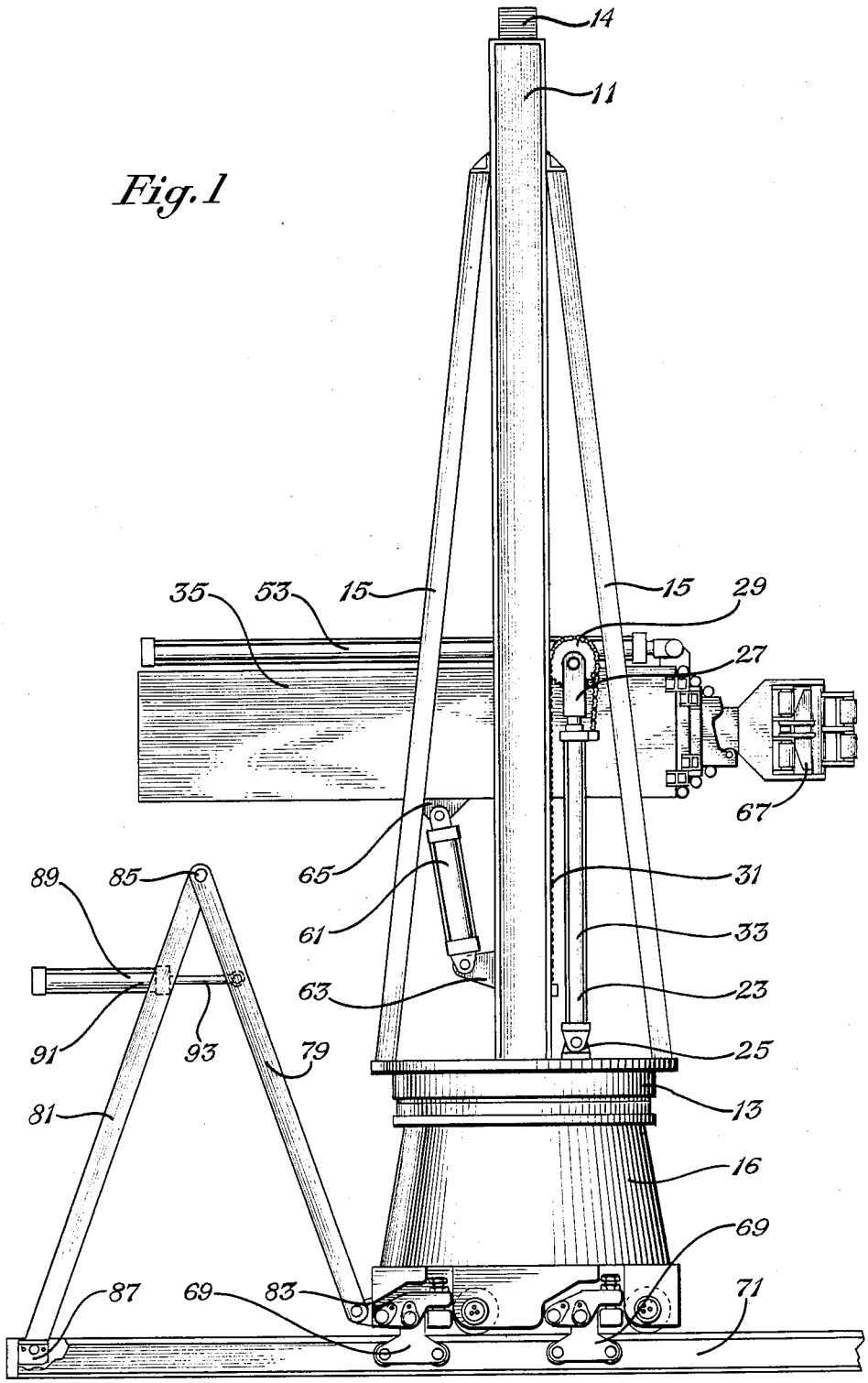
FIG. 1 is a side view of the pipe handling machine of the invention.
Figure 2:
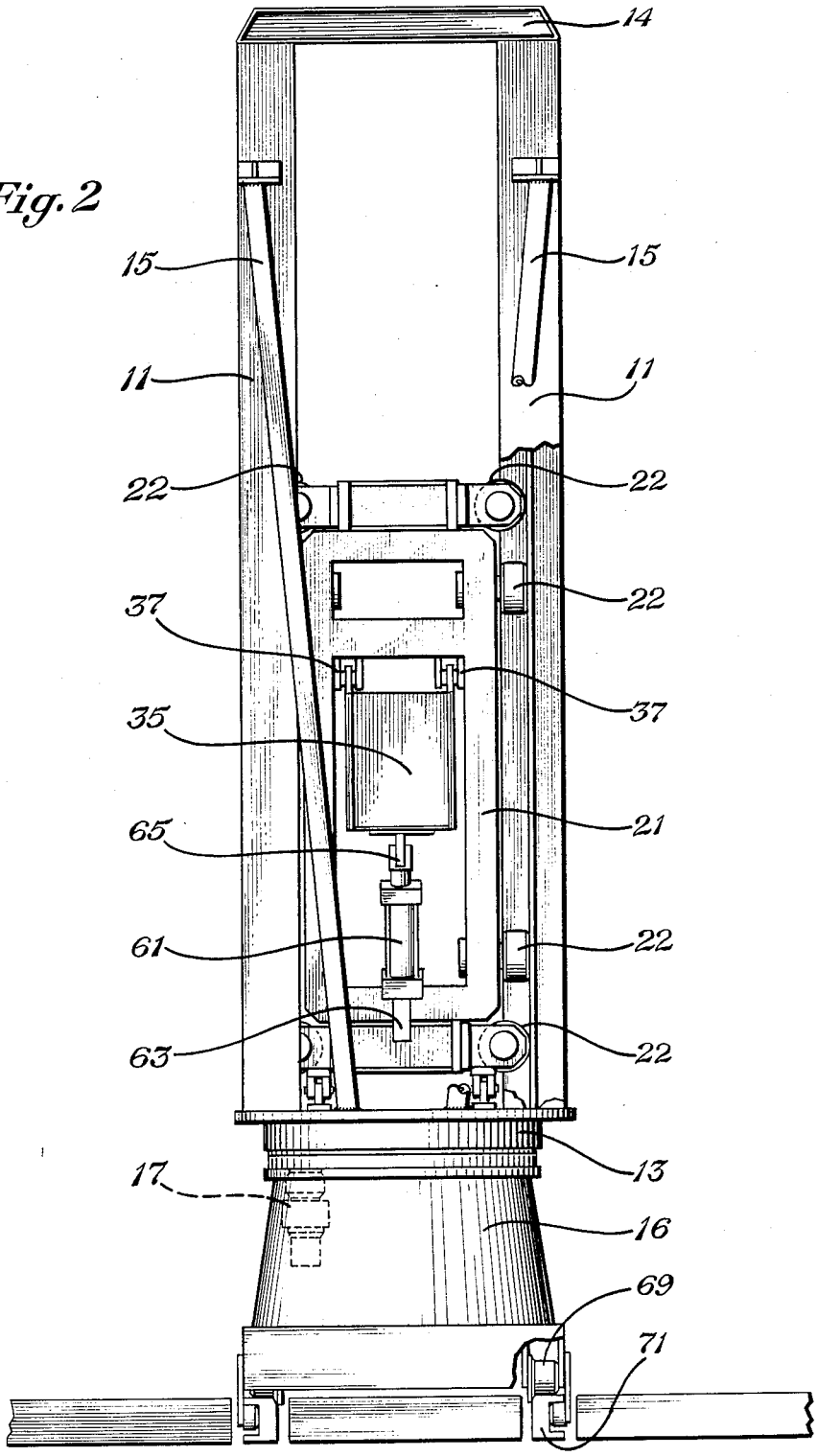
FIG. 2 is a rear view of the pipe handling machine of the invention.

As shown in FIGS. 1 and 2, the pipe handling machine of the invention has two parallel tracks 11, which extend upward from a base 13. A horizontal member 14 is connected between the tops of the two vertical tracks 11. Four bracing members 15 extend from the base 13 to near the tops of the vertical tracks 11. The base 13 is preferably a turntable bearing, as shown, and is mounted on a trolley 16. The two vertical tracks 11 rotate with the base 13.

Figure 9:
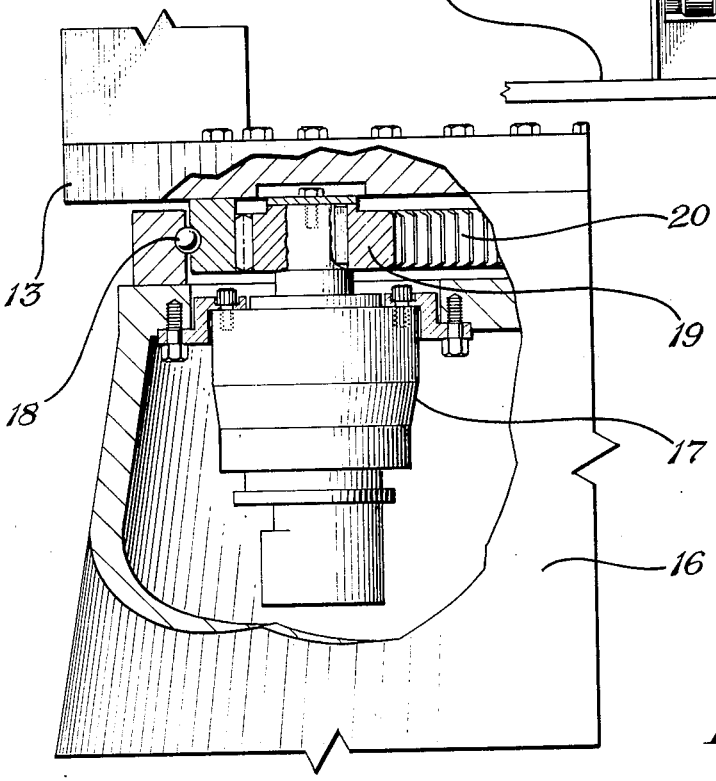
FIG. 9 is a sectional view showing the turntable drive motor.

A turntable drive motor 17 is housed within the trolley 16, and is a means for rotating the base 13 about a vertical axis. The drive motor 17 is shown in greater detail in FIG. 9. A plurality of ball bearings 18 allow the base 13 to rotate relative to the trolley 16. A drive gear 19 on the drive motor engages teeth 20 on the base 13 to rotate the base 13 when the drive motor 17 is activated.

A rectangular carriage 21 is mounted between the vertical tracks 11. The carriage 21 has rollers 22, so that the carriage 21 can move vertically along the tracks 11.

A fluid cylinder and piston assembly 23 is attached to a clevis 25 on the base 13, and extends upward. The upper end of the piston rod 27 is attached to a rotatable gear 29. A chain 31 is connected to the carriage 21 and to the fluid cylinder 33, and passes over the rotatable gear 29. The carriage 21 can be moved vertically by extending or retracting the piston rod 27.

Figure 7:
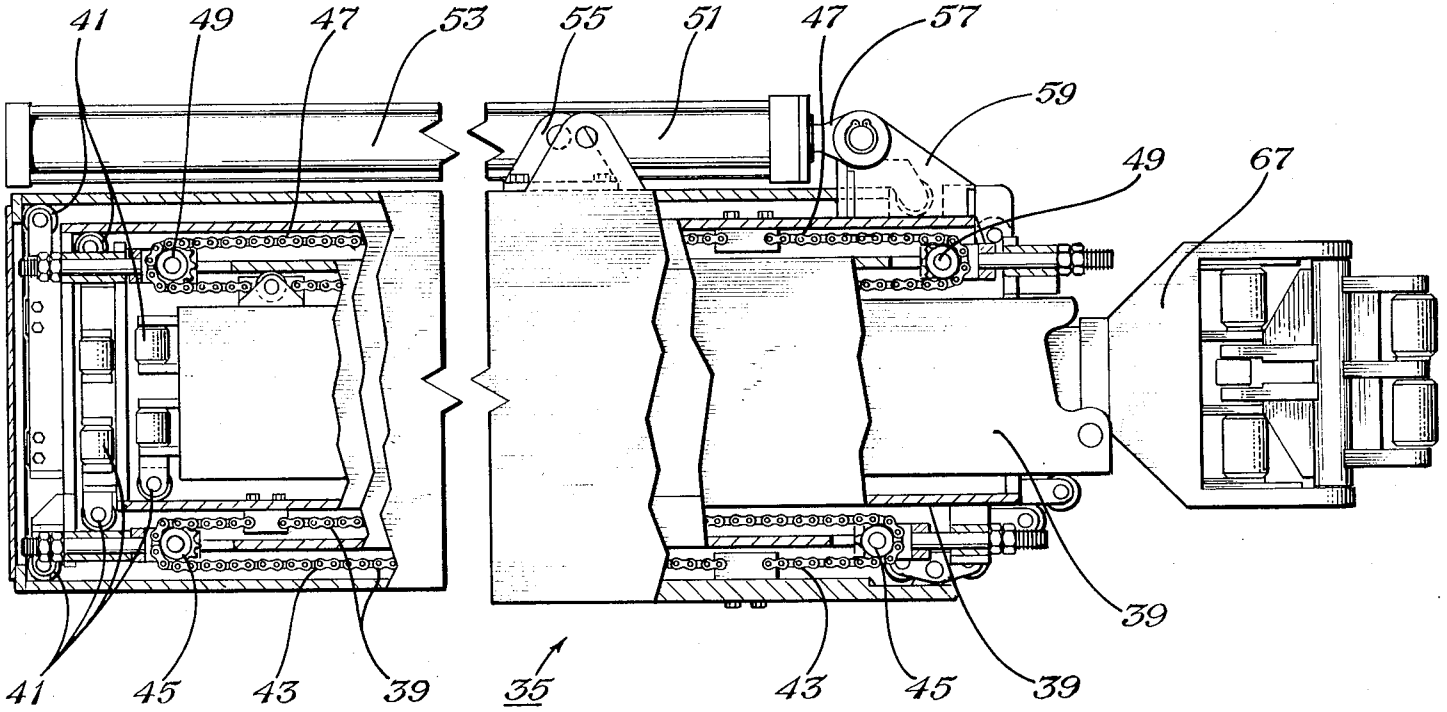
FIG. 7 is a sectional side view of the boom.

A multisection, telescoping boom 35 is carried by the carriage 21. The boom 35 is suspended from a pair of clevises 37, as shown in FIG. 2. The sections of the boom 35 are shown in detail in FIG. 7.

The boom 35 has four telescoping sections 39, which are separated by rollers 41. The first and third sections 39 are connected together by a chain 43, which passes around a pair of rotatable gears 45. These gears 45 are attached to the second section 39. Likewise, the second and fourth sections 39 are connected by a chain 47, which passes around a pair of rotatable gears 49. This second pair of gears 49 is attached to the third section 39 of the boom 35.

The boom 35 is extended and retracted by means of a fluid cylinder and piston assembly 51. The fluid cylinder 53 of the assembly 51 is attached to a clevis 55 on top of the first section 39 of the boom 35. The piston rod 57 of the assembly 51 is attached to a flange 59, which extends upward from the second section 39 of the boom 35. When the piston rod 57 is extended, the first and second sections 39 of the boom 35 are telescopically extended. Since all four of the sections 39 are connected by the chains 43,47, the extension of the piston rod 57 extends all four sections 39 of the boom 35.

Figure 8:
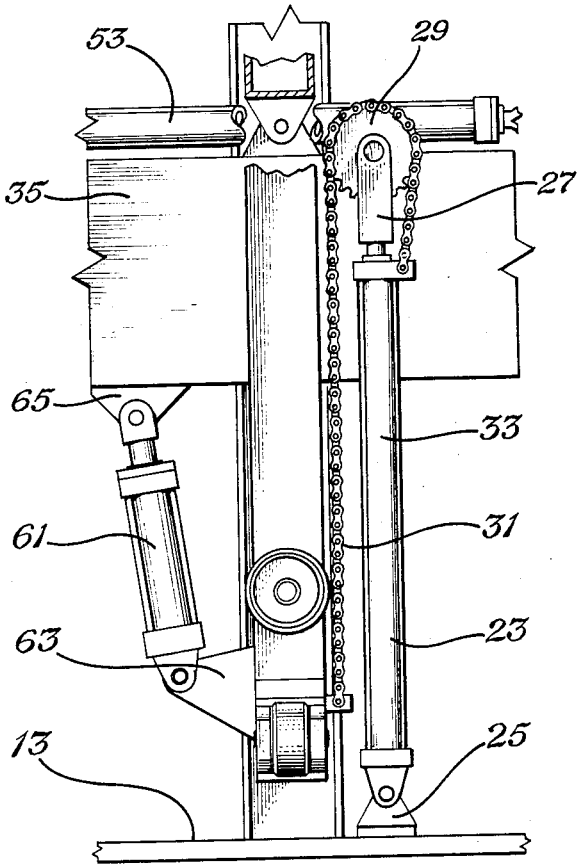
FIG. 8 is a partial side view of the pipe handling machine.

As shown in FIGS. 1, 2, 8, another fluid cylinder and piston assembly 61 is connected between a flange 63 on the rectangular carriage 21 and a flange 65 on the bottom of the boom 35. This assembly 61 is a means for causing the boom 35 to rotate, or luff, about a horizontal axis through the clevises 37 on the carriage 21.

A pipe-engaging head 67 is mounted on the end of the boom 35. This head 67 may be of any standard design, well known in the art.

Figure 6:
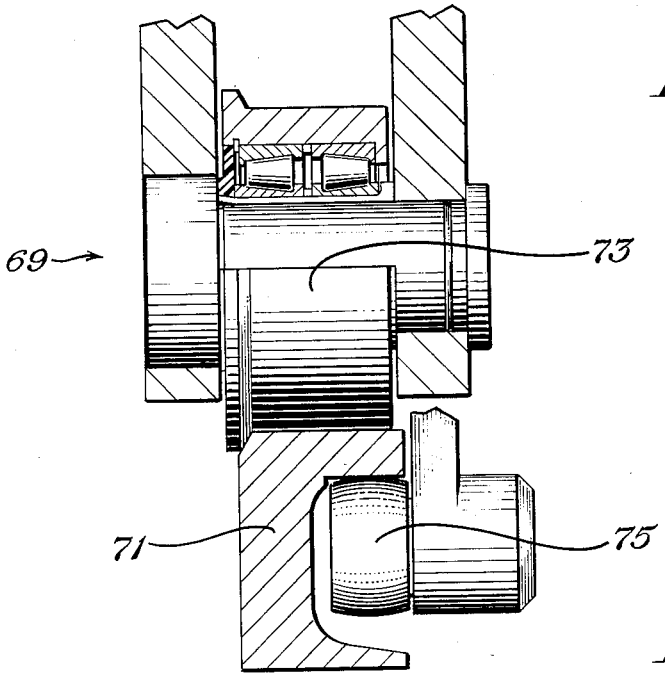
FIG. 6 is a sectional view of a trolley wheel in engagement with a track.

FIGS. 1 and 2 show that the trolley 16 runs on four sets of wheels 69, which engage a set of tracks 71. The preferred design of the wheel sets 69, as shown in FIG. 6, includes both upper wheels 73 and lower wheels 75. The upper wheels 73 run along the top of the track 71, and the lower wheels 75 roll along a reverse surface 77 of the track 71.

There are, of course, many ways to move the trolley 16 along the track 71. The preferred method involves a pair of elongated members 79,81. One of the members 79 is connected to a flange 83 on the trolley 16, and extends diagonally upward, as shown in FIG. 1. The second member 81 is pivotally attached to the first member 79 at pivot point 85. The second member 81 extends diagonally downward to a clevis assembly 87, which is releasably attached to the track 71.

The trolley 16 is moved by a fluid cylinder and piston assembly 89. The cylinder 91 of the assembly 89 is attached to one of the members 81, and the piston rod 93 of the assembly 89 is attached to the other member 79. When the piston rod 93 is extended, the two members 79,81 are forced apart, and the trolley 16 is moved down the track 71 away from the clevis assembly 87. To move the trolley 16 toward the clevis assembly 87, the piston rod 93 is retracted. The clevis assembly 87 can be easily disconnected and moved to another location on the track 71, so that the trolley 16 can continue its movement.

Figure 3:
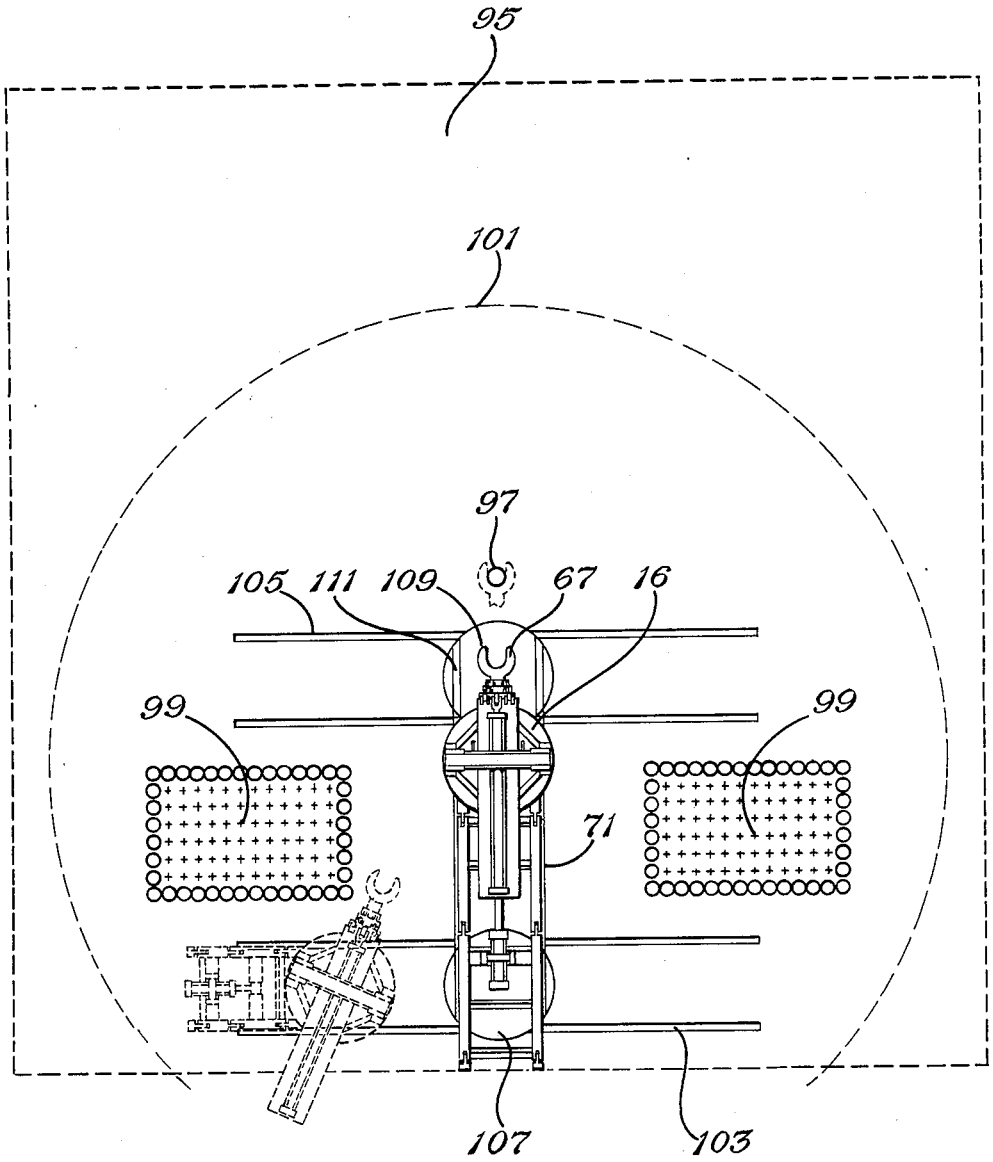
FIG. 3 is a top view of the invention, located on a typical rig floor.

FIG. 3 shows the pipe handling machine of the invention on a typical rig floor 95. The trolley 16 engages a set of tracks 71, which run between the well center 97 and the setback areas 99. From the position shown in FIG. 3, the pipe-engaging head 67 can be extended or retracted to reach any area of the rig floor 95 within the circle 10. From this position, the head 67 can control a section of drill pipe during the entire trip from the setback area 99 to the well center 97.

A second set of tracks 103 also extends across the rig floor 95, transverse to the first set 71, and behind the setback areas 99. Whenever the pipe handling machine is not in use it can be moved out of the way to the position shown in shadow in FIG. 3. A third set of tracks 105 is also shown, transverse to the first set 71. This third set of tracks 105 allows the trolley 16 to be moved across the rig floor 95 in front of the setback areas 99.

When more than one set of tracks are used, some means must be provided for transferring the trolley 16 from one set of tracks to another. In the preferred embodiment, a turntable 107 is used to transfer the trolley 16 between the first and second sets of tracks 71, 103. A second turntable 109 is used between the first and third sets of tracks 71, 105.

Figure 4:
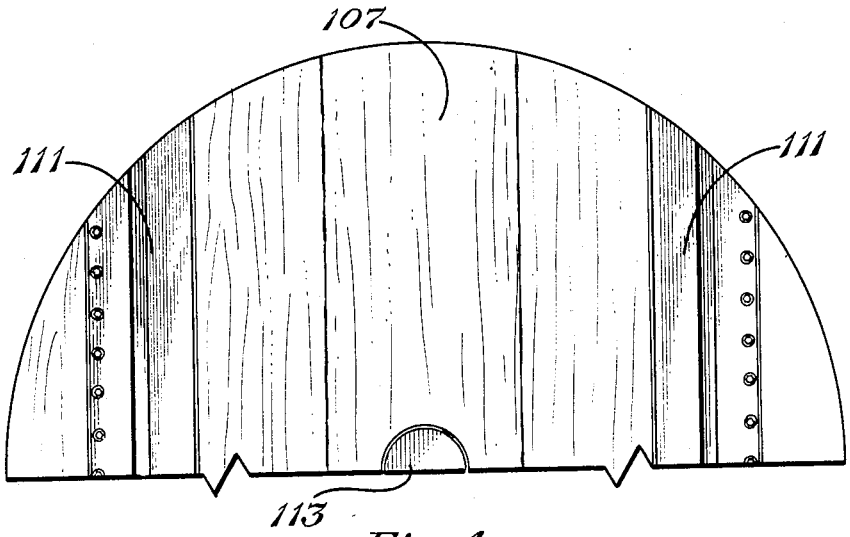
FIG. 4 is a partial view of the turntable.
Figure 5:
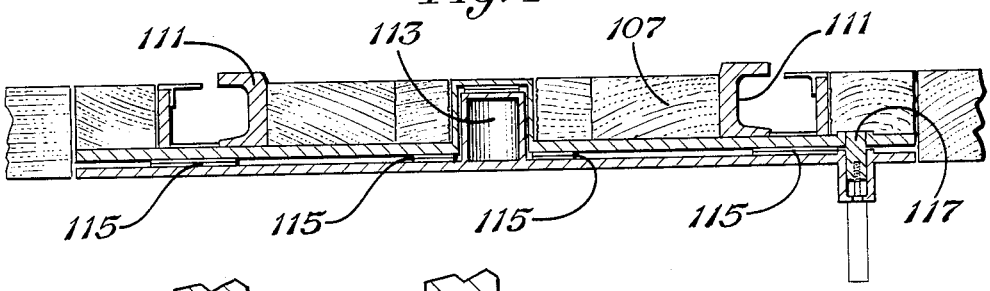
FIG. 5 is a sectional side view of the turntable.

FIGS. 4 and 5 show the details of one of the two turntables 107. The turntable is circular, and has a set of tracks 111, similar to the other tracks 71. The turntable 107 is supported on a center post 113 and on bearings 115, so that the turntable 107 can be rotated about the center post 113. A locking mechanism 117 is provided to lock the turntable 107 in alignment with either set of tracks 71,103.

The trolley 16 is transferred from one set of tracks 71 to another 103 by first moving the trolley 16 onto the turntable 107. The clevis assembly 87 and the locking mechanism 117 are released, and the turntable is rotated ninety degrees to align the turntable tracks 111 with the other set of tracks 103. The clevis assembly 87 is then connected to the tracks 103 and the trolley can be moved along the other tracks 103.

While the invention has been described in only one of its forms, it should be apparent to those skilled in the art that it is not so limited, but is susceptible to various changes and modifications without departing from the spirit thereof.

We claim:

1. A pipe handling machine, comprising:

a first set of tracks extending across a rig floor, toward and away from the well center, the rig floor having an upper surface which defines a horizontal plane, the tracks being flush with the upper surface of the rig floor so that the tracks do not protrude past the horizontal plane;

a second set of tracks extending across the rig floor, transverse to the first set, the second set of tracks also being flush with the upper surface of the rig floor;

a trolley, engaging one set of tracks;

a turntable for transferring the trolley from one set of tracks to the other set of tracks;

means for moving the trolley along the tracks;

a base, mounted on the trolley;

means for rotating the base about a vertical axis; two parallel vertical tracks, extending upward from the base for movement with the base;

a carriage, mounted on the vertical tracks, for vertical movement along the tracks;

means for moving the carriage along the vertical tracks;

a multisection telescoping boom, connected to the carriage for movement therewith;

means for telescopically extending and retracting the boom;

means for luffing the boom about a horizontal axis; and a pipe-engaging head, mounted on the boom.

2. A pipe handling machine, comprising:

a first set of tracks extending across a rig floor, toward and away from the well center, the rig floor having an upper surface which defines a horizontal plane, the tracks being flush with the upper surface of the rig floor so that the tracks do not protrude past the horizontal plane;

a second set of tracks extending across the rig floor transverse to the first set, the second set of tracks being flush with the upper surface;

a trolley, engaging one set of tracks;

a turntable for transferring the trolley from one set of tracks to the other set of tracks, the turntable being supported on a center post and being rotatable about the center post for alignment with each set of tracks, the turntable also being flush with the upper surface of the rig floor;

a base, mounted on the trolley;

means for rotating the base about a vertical axis;

two parallel vertical tracks, extending upward from the base for movement with the base;

a carriage, mounted on the vertical tracks, for vertical movement along the tracks;

means for moving the carriage along the vertical tracks;

a multisection telescoping boom, connected to the carriage for movement therewith;

means for telescopically extending and retracting the boom;

means for luffing the boom about a horizontal axis; and a pipe-engaging head, mounted on the boom.

3. A pipe handling machine, comprising:

a first set of tracks extending across a rig floor, toward and away from the well center;

a second set of tracks extending across the rig floor, transverse to the first set;

a trolley, engaging one set of tracks;

means for transferring the trolley from one set of tracks to the other set of tracks;

means for moving the trolley along the tracks;

a base, mounted on the trolley;

means for rotating the base about a vertical axis;

two parallel vertical tracks, extending upward from the base for movement with the base;

a carriage, mounted on the vertical tracks, for vertical movement along the tracks means for moving the carriage along the vertical tracks;

a multisection telescoping boom, connected to the carriage for movement therewith;

means for telescopically extending and retracting the boom;

means for luffing the boom about a horizontal axis;

a pipe-engaging head, mounted on the boom;

a first elongate member releasably connected at one end to a first location on the rig floor and having an opposite end, a second elongate member connected at one end to the trolley and pivotally connected at an opposite end to the opposite end of the first elongate member;

means for urging the elongate members apart to move the trolley along the first rig floor track; and a second connection point for the first elongate member when the trolley is transferred to the second rig floor track whereby the same means for urging can be utilized to move the trolley along the second rig floor track.

* * * * *